US011331235B2

(12) United States Patent
Kurt et al.

(10) Patent No.: US 11,331,235 B2
(45) Date of Patent: May 17, 2022

(54) PATIENT REPOSITIONING SHEET, SYSTEM, AND METHOD

(71) Applicant: Medline Industries, LP, Northfield, IL (US)

(72) Inventors: Alyssa Kurt, Trevor, WI (US); Morgan Uridil, Evanston, IL (US); Stephen Kaidantsis, Chicago, IL (US); Vincent Hahn, Chicago, IL (US); Drew Phalen, Skokie, IL (US)

(73) Assignee: Medline Industries, LP, Northfield, IL (US)

( * ) Notice: Subject to any disclaimer, the term of this patent is extended or adjusted under 35 U.S.C. 154(b) by 48 days.

(21) Appl. No.: 16/570,271

(22) Filed: Sep. 13, 2019

(65) Prior Publication Data

US 2021/0077327 A1 Mar. 18, 2021

(51) Int. Cl.
*A61G 7/10* (2006.01)

(52) U.S. Cl.
CPC ..... *A61G 7/1028* (2013.01); *A61G 7/1021* (2013.01); *A61G 7/1026* (2013.01); *A61G 2200/327* (2013.01)

(58) Field of Classification Search
CPC .. A61G 7/1028; A61G 7/1021; A61G 7/1026; A61G 2200/327
See application file for complete search history.

(56) References Cited

U.S. PATENT DOCUMENTS 5,067,189 A 11/1991 Weedling
5,092,007 A * 3/1992 Hasty ..... A61G 7/001 5/691
5,442,821 A 8/1995 Weeks
RE35,299 E 7/1996 Weedling et al.
5,561,873 A 10/1996 Weedling
6,073,291 A 6/2000 Davis
6,898,809 B2 5/2005 Davis
7,028,350 B1 4/2006 Davis
7,107,641 B2 9/2006 Davis
7,114,204 B2 10/2006 Patrick
7,168,115 B2 1/2007 Davis
7,210,176 B2 5/2007 Weedling
(Continued)

FOREIGN PATENT DOCUMENTS

EP 0913138 5/1999
WO 2012103232 8/2012
WO 2012170934 12/2012

OTHER PUBLICATIONS

Frontier Medical Group, "Automated Patient Turning Repositioned," (2018), 3 pages.
(Continued)

*Primary Examiner* — David R Hare
*Assistant Examiner* — Madison Emanski
(74) *Attorney, Agent, or Firm* — Fitch, Even, Tabin & Flannery LLP

(57) ABSTRACT

In one aspect, the present disclosure provides a patient repositioning sheet including an inflatable sheet having a lower layer and an upper layer that are urged apart with inflation of the inflatable sheet. The patient repositioning sheet further includes at least one inflatable support, such as an inflatable wedge. The inflatable wedge has a wedge surface that extends obliquely to the upper layer of the inflatable sheet with the inflatable wedge inflated.

18 Claims, 6 Drawing Sheets

(56) References Cited

U.S. PATENT DOCUMENTS 7,243,382 B2 7/2007 Weedling
7,266,852 B2 9/2007 Davis
7,337,477 B2 3/2008 Scordato
7,373,680 B2 5/2008 Davis
7,376,995 B2 5/2008 Davis
7,406,723 B2 8/2008 Davis
7,415,738 B2 8/2008 Weedling
7,467,431 B2 12/2008 Weedling
7,565,709 B2 7/2009 Davis
7,574,761 B2 8/2009 Davis
7,627,910 B2 12/2009 Davis
7,650,654 B2 1/2010 Lambarth
7,681,262 B2 3/2010 Weedling
7,712,170 B2 5/2010 Davis
7,735,164 B1 6/2010 Patrick
7,739,758 B2 6/2010 Weedling
7,849,533 B1 12/2010 Receveur
7,861,335 B2 1/2011 DeLuca
7,900,299 B2 3/2011 Weedling
7,975,330 B2 7/2011 Receveur
8,006,333 B2 8/2011 Genaro
8,011,039 B2 9/2011 Stryker
8,201,292 B2 6/2012 Dionne
8,234,727 B2 8/2012 Schreiber
8,276,222 B1 10/2012 Patrick
8,296,887 B2 10/2012 Doehler
8,387,177 B2 * 3/2013 Davis ..... A61G 7/1028 5/81.1 R
8,397,326 B2 3/2013 Lafleche
D690,424 S 9/2013 Ponsi
8,566,977 B2 10/2013 Davis
8,656,529 B2 2/2014 Corriveau
8,756,725 B2 6/2014 Piegdon
8,776,290 B2 7/2014 Wilkinson
8,782,826 B2 7/2014 White
8,789,533 B2 7/2014 Steffens
8,832,885 B2 9/2014 Lafleche
8,850,634 B2 10/2014 Ponsi
8,856,992 B2 10/2014 Lafleche
8,887,326 B2 11/2014 Patrick
8,910,325 B2 12/2014 Faucher
8,911,387 B2 12/2014 Lafleche
8,984,681 B2 3/2015 Ponsi
9,101,521 B2 8/2015 White
9,114,050 B2 8/2015 White
9,125,777 B2 9/2015 Patrick
9,132,052 B2 9/2015 Fowler
9,156,656 B2 10/2015 Rosenthal
9,222,498 B2 12/2015 Faucher
9,241,580 B2 1/2016 Patrick
9,278,038 B2 3/2016 Masucci
9,314,388 B2 4/2016 Patrick
9,414,977 B2 8/2016 Ponsi
9,421,140 B2 8/2016 Faucher
9,427,367 B2 8/2016 White
9,456,944 B2 10/2016 Berg
9,615,983 B2 4/2017 Stryker
9,693,919 B2 7/2017 Berman
9,693,920 B2 7/2017 Fowler
9,782,312 B2 10/2017 Brubaker
9,820,902 B2 11/2017 Ponsi
9,820,903 B2 11/2017 Steffens
9,820,904 B2 11/2017 Lafleche
9,849,053 B2 12/2017 Rigoni
9,861,544 B2 1/2018 Rigoni
9,877,884 B2 1/2018 Berg
10,039,680 B2 8/2018 Galbraith
10,064,773 B2 9/2018 Rigoni
10,117,800 B1 11/2018 Galbraith
10,182,956 B2 1/2019 Stryker
10,244,994 B2 4/2019 Davis
10,398,614 B2 9/2019 Rigoni
10,561,557 B2 2/2020 Emerson
10,588,800 B2 3/2020 Fletcher
10,624,806 B2 4/2020 Emerson
10,828,216 B2 * 11/2020 Phalen ..... A61G 7/1021
2005/0028273 A1 2/2005 Weedling
2005/0034242 A1 2/2005 Davis
2005/0076437 A1 4/2005 Johnson
2006/0000016 A1 1/2006 Weedling
2006/0021133 A1 2/2006 Davis
2006/0282946 A1 12/2006 Meyer
2007/0006388 A1 1/2007 Townsend
2007/0240260 A1 10/2007 White
2007/0266494 A1 11/2007 DeLuca
2008/0000028 A1 1/2008 Lemire
2008/0028516 A1 2/2008 Morishima
2008/0120780 A1 5/2008 Genaro
2008/0141463 A1 6/2008 Dionne
2008/0209630 A1 9/2008 Kazala
2008/0263763 A1 10/2008 Butler
2008/0289102 A1 11/2008 Davis
2010/0071137 A1 * 3/2010 Doehler ..... A61G 7/05784 5/713
2010/0229298 A1 9/2010 Davis
2010/0287698 A1 11/2010 Stryker
2011/0056017 A1 3/2011 Schreiber
2011/0072579 A1 3/2011 Receveur
2011/0092890 A1 4/2011 Stryker
2011/0289691 A1 12/2011 Lafleche
2011/0296623 A1 12/2011 Lafleche
2011/0296624 A1 12/2011 Lafleche
2011/0301516 A1 12/2011 Lafleche
2012/0186012 A1 7/2012 Ponsi
2012/0186013 A1 7/2012 Ponsi
2012/0186587 A1 7/2012 Steffens
2012/0210511 A1 8/2012 Davis
2013/0042414 A1 2/2013 Schreiber
2013/0061396 A1 3/2013 Lafleche
2013/0205495 A1 8/2013 Ponsi
2013/0219628 A1 8/2013 Blanchard
2013/0227787 A1 9/2013 Herbst
2013/0318708 A1 12/2013 Wang
2014/0007353 A1 * 1/2014 Stryker ..... A61G 7/05792 5/715
2014/0041114 A1 2/2014 Davis
2014/0059780 A1 3/2014 Lafleche
2014/0259400 A1 9/2014 Stryker
2014/0304918 A1 10/2014 Steffens
2015/0000045 A1 1/2015 Lafleche
2015/0047121 A1 2/2015 Berg
2015/0074903 A1 3/2015 Berg
2015/0101126 A1 4/2015 Reiners
2015/0143628 A1 5/2015 Fowler
2015/0342811 A1 12/2015 Wong
2016/0008194 A1 1/2016 Ponsi
2016/0095777 A1 4/2016 Berman
2016/0331611 A1 11/2016 Ponsi
2016/0367422 A1 12/2016 Weedling
2016/0374883 A1 12/2016 Galbraith
2017/0049646 A1 2/2017 Rigoni
2017/0049647 A1 2/2017 Rigoni
2017/0065476 A1 3/2017 Berg
2017/0119608 A1 5/2017 Rigoni
2017/0143565 A1 5/2017 Childs
2017/0151112 A1 6/2017 Fletcher
2017/0172827 A1 6/2017 Schaaf
2017/0216117 A1 8/2017 Rigoni
2017/0296414 A1 10/2017 Fowler
2017/0326011 A1 11/2017 Alvarez
2018/0049935 A1 2/2018 Rigoni
2018/0071158 A1 3/2018 Lafleche
2018/0200130 A1 7/2018 Liu
2018/0250180 A1 9/2018 Phalen
2018/0303690 A1 10/2018 Hahn
2018/0318162 A1 11/2018 Galbraith
2018/0353360 A1 12/2018 Kea
2018/0369048 A1 12/2018 Rigoni et al.
2018/0369050 A1 12/2018 Davis
2019/0083341 A1 3/2019 Ulreich
2019/0091085 A1 3/2019 Emerson
2019/0091086 A1 3/2019 Emerson
2019/0091088 A1 3/2019 Emerson
2019/0201261 A1 7/2019 Galer

(56) References Cited

U.S. PATENT DOCUMENTS

| | | | |
|---|---|---|---|
| 2019/0201262 | A1 | 7/2019 | Galer |
| 2019/0216663 | A1 | 7/2019 | Ulreich |
| 2019/0231624 | A1 | 8/2019 | Lafleche |
| 2019/0380899 | A1 | 12/2019 | Rigoni |
| 2020/0078243 | A1 | 3/2020 | Berg |
| 2020/0129355 | A1 | 4/2020 | Emerson |

OTHER PUBLICATIONS

Image of ArjoHuntleigh's Repositioning Sheet, date unknown.
Images from Prevalon™ AirTAP System™ Demo, product video at https://www.youtube.com/watch?v=BtEaFrElfcU; Sage Products LLC; published on Aug. 9, 2016, 10 pages.
Images of Handicare's SystemRoMedic™—SafeHandlingSheet, date unknown.
PCT Search Report and Written Opinion from International Application No. PCT/US2018/017948 dated Jun. 27, 2018; 15 pages.
PCT Search Report and Written Opinion from International Patent Application No. PCT/US2018/025871 dated Aug. 13, 2018; 12 pages.
Transcription of and images from Prevalon® Turn & Position System product video at https://www.youtube.com/watch?v=VT82CV1couA; Sage Products LLC published on Dec. 10, 2013, 33 pages.
Transcription of and images of AirPal Air-Assisted Lateral Patient Transfer, product demo at https://www.youtube.com/watch?v=l7K5s_9Cr2c; AirPal, Inc.; published on May 1, 2014, 36 pages.
Transcription of and images of Comfort Glide™ Patient Repositioning System, product video at https://vimeo.com/90363103; Medline Industries, Inc.; publicly available at least as of Mar. 2014, 51 pages.
Transcription of and images of HoverMatt® Air Transfer System, product video at https://www.youtube.com/watch?v=8x6XmF5hgyg; CJ Medical; published on Oct. 15, 2014, 7 pages.

* cited by examiner

PATIENT REPOSITIONING SHEET, SYSTEM, AND METHOD

FIELD

This disclosure relates to patient transfer devices and, more specifically, to inflatable patient transfer sheets.

BACKGROUND

Inflatable patient transfer sheets are used to transfer patients from one surface to another, such as from a hospital bed to a gurney. Inflatable patient transfer sheets often include an interior volume that is filled with air via a pump. Inflating the patient transfer sheet increases the area that the patient's weight is distributed across, which makes it easier to move the patient. Inflatable patient transfer sheets may also include a series of holes in a bottom surface of the inflatable transfer sheet that permit air to flow downwardly against an underlying surface such as a hospital bed. The air creates an air bearing between the inflatable patient transfer sheet and further reduces resistance to movement of the patient.

Comatose patients or patients with limited movement may need to be turned periodically to limit the development of pressure ulcers on the patient's skin. Foam wedges are often used to lift one side of a patient to relieve pressure on the patient's skin. To position a foam wedge under a side of a patient, the patient may be log rolled in a first direction to elevate the one side of the patient off of a hospital bed, the foam wedge positioned beneath the patient, and the patient log rolled in a second direction opposite the first direction to position the one side of the patient on the foam wedge. A second log rolling process is subsequently performed to remove the foam wedge from under the patient and a third log rolling process is performed to position the foam wedge under the other side of the patient.

The repeated log rolling of the patient and placement/removal of the foam wedges are labor intensive processes, especially for heavier patients. Further, a patient supported by a foam wedge may need to be transferred to a gurney or another surface, which requires the foam wedge to be removed and an inflatable transfer sheet to be positioned beneath the patient. The inflatable transfer sheet may be positioned under the patient using another log rolling procedure that involves positioning part of a folded inflatable sheet beneath the patient once the patient has been log rolled onto one side, log rolling the patient in an opposite direction to position the patient's other side on the folded inflatable sheet, unfolding the inflatable sheet beneath the patient, then log rolling the patient's back onto the unfolded inflatable sheet. The sheet may then be inflated and pulled and/or pushed to shift the inflatable sheet and patient thereon to another surface. The process of positioning the patient on an inflatable sheet is further manual labor that complicates patient care.

DETAILED DESCRIPTION

Figure 1:
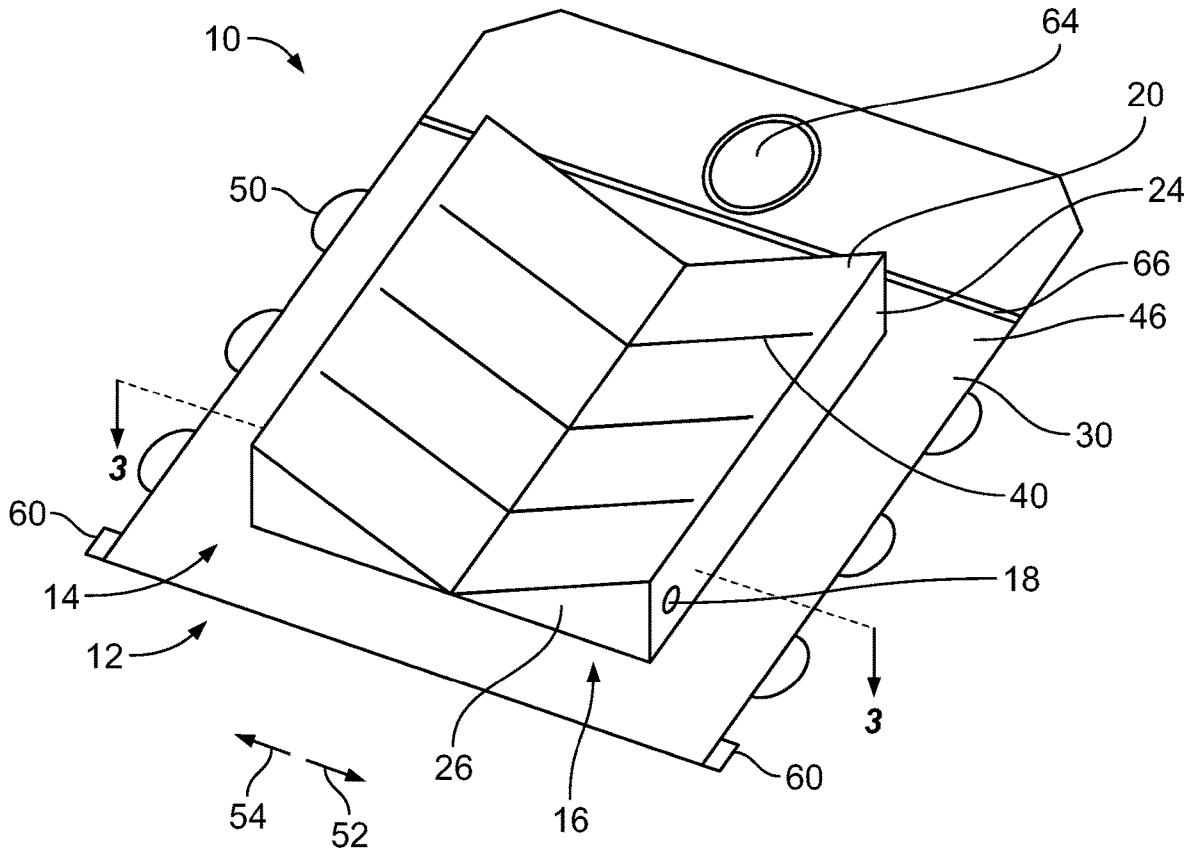
FIG. 1 is a perspective view of a patient repositioning sheet including an inflatable sheet and a pair of inflatable wedges of the inflatable sheet.

Regarding FIG. 1, an inflatable patient repositioning sheet 10 is provided that includes an inflatable sheet 12 and one or more inflatable supports, such as inflatable wedges 14, 16. The inflatable wedges 14, 16 each have one or more wedge air inlets 18 that may be connected to a hose of an air pump to receive air from the pump and inflate the respective wedge 14, 16. The wedges 14, 16 may be inflated one at a time to elevate a respective portion of the patient and relieve pressure on the skin of the patient. The inflatable wedges 14, 16 may be deflated by disconnecting the tube of the pump from the wedge air inlet 18 and permitting the air to escape either through the wedge air inlet 18 or through an upper wall 20 of the inflatable wedges 14, 16. The upper wall 20 may be made of a breathable, air permeable material which improves the feel of the upper wall 20 against a patient. For example, the upper wall 20 may be made of a nylon material having a water vapor transmission rate in the range of 23-440 $g/m^2$ per day as determined by the ASTM E96/E96M testing standard.

Figure 2:
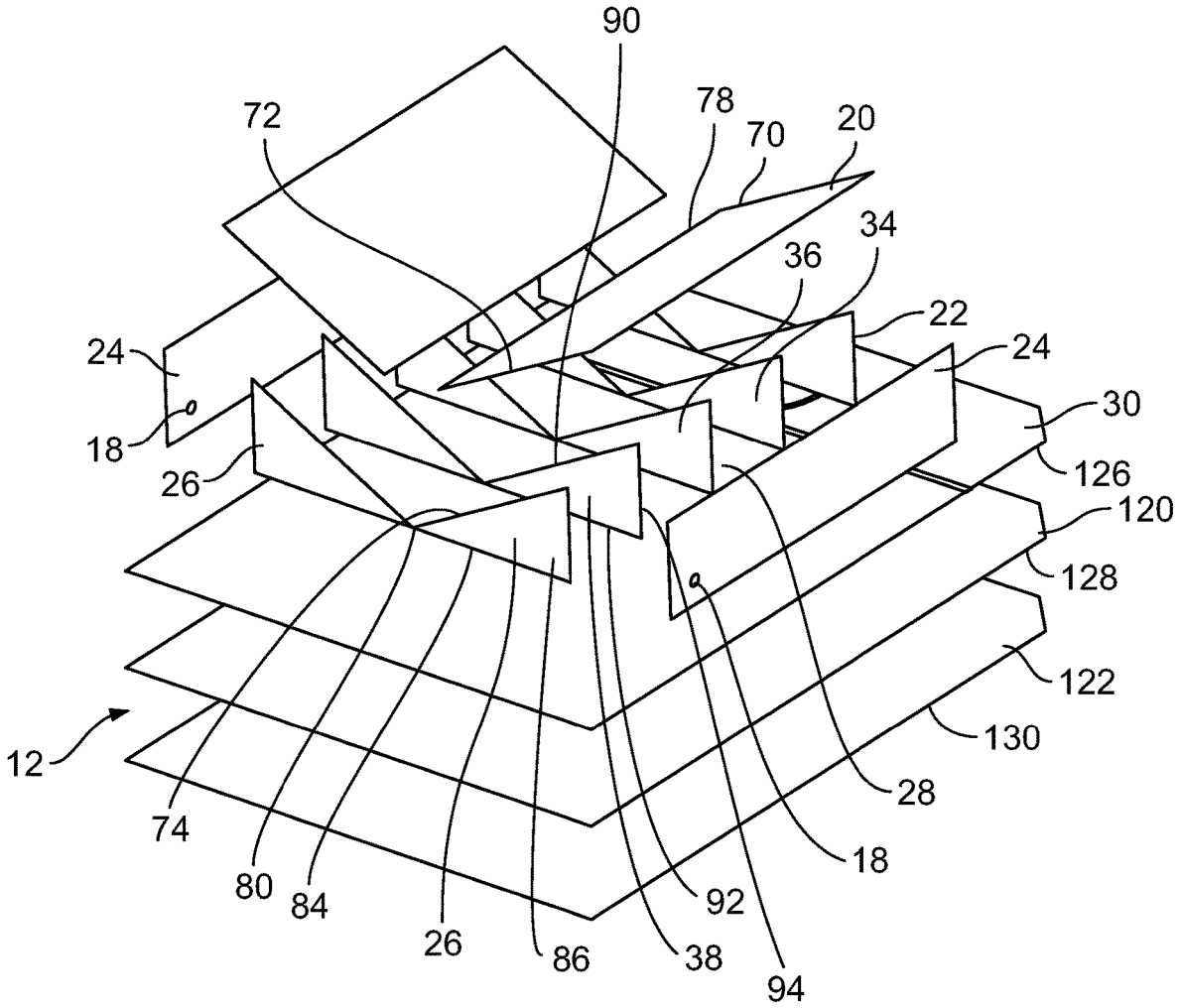
FIG. 2 is an exploded view of a portion of the patient repositioning sheet of FIG. 1.

Regarding FIG. 2, each inflatable wedge 14, 16 includes one or more walls, such as the upper wall 20, an end wall 22, a side wall 24, an end wall 26, and a portion 28 of an uppermost layer, such as a cover layer 30, of the inflatable patient repositioning sheet 10. The inflatable patient repositioning sheet 10 includes an upper patient support layer, such as upper layer 120, and a lower base layer, such as a lower layer 122. The upper layer 120 and lower layer 122 define an interior volume therebetween that receives air from an air pump at one or more sheet air inlets 60. The layers 30, 120, 122 may each be made of nylon as an example. The layer 30 may be made of a microfiber material.

The one or more walls of the inflatable wedge 14, 16 define an interior volume 35 (see FIG. 3) of the inflatable wedge 14, 16 that is in communication with the respective wedge air inlet 18. The wedge air inlet 18 may include or may have connected thereto a one-way valve that permits air to enter the inflatable wedge 14, 16 but prevents air exiting the inflatable wedge 14, 16 via the wedge air inlet 18. The air wedge inlet 18 may be directly in communication with the interior volume of the inflatable wedge 14, 16 such as if the air wedge inlet 18 is formed in the side wall 24. In another embodiment, the air wedge inlet 18 is indirectly in communication with the interior volume 35 of the inflatable wedge 14, 16 and remote from the associated wedge 14, 16. For example, the air wedge inlet 18 may be located near the sheet air inlet 60 and the inflatable patient repositioning sheet 10 includes a channel defined between the cover layer 30 and the upper layer 120 that communicates air from the remote air wedge inlet 18 to the interior volume 35 of the associated inflatable wedge 14, 16. In one embodiment, the interior volumes 35 of the inflatable wedges 14, 16 are not in communication with the interior volume of the inflatable sheet 12 defined between the upper layer 120 and the lower layer 122. The inflatable sheet 12 and inflatable wedges 14, 16 may each be independently inflated or deflated without inflating or deflating the others.

Regarding FIGS. 1 and 2, each inflatable wedge 14, 16 includes one or more internal baffles, such as baffles 34, 36, 38. The baffles 34, 36, 38 and walls 22, 24, 26 may me made of an air impermeable material, such as polyurethane. In another embodiment, the walls 22, 24, 26 may be made of a material that is air-permeable, but with an air-permeability less than the air permeability of the upper wall 20. The air permeability of the walls 20, 22, 24, 26 may be selected to control the deflation rate of the wedge 14, 16.

The baffles 34, 36, 38 are connected to the upper wall 20 via joints 40, such as seams, and are connected to the portion 28 of the cover layer 30 at joints 44. The joints 40, 44 may be formed using heat welds, ultrasonic welds, fusible tape, fusible thread, and/or adhesive as some examples. Fusible thread may be used to stitch fabrics together and melted using heat to fuse the fabrics together The joints between the various components of the inflatable wedges 14, 16 may be airtight such that the only way air may exit the inflatable wedges 14, 16 after inflation of the inflatable wedges 14, 16 is through the upper wall 20 of the inflatable wedges 14, 16. In one embodiment, the material of the wedges 14, 16 are selected so that the inflatable wedges 14, 16 will remain inflated for at least a predetermined time, such as two hours, after the air pump is turned off or disconnected from the inflatable wedges 14, 16. In another embodiment, the associated pump runs continuously or intermittently for the period of time the inflatable wedges 14, 16 are employed to keep the inflatable wedges 14, 16 inflated.

Upon inflation of the inflatable wedges 14, 16, the baffles 34, 36, 38 are placed in tension and resist ballooning of the upper wall 20 to maintain the shape of the inflatable wedge 14, 16. Further, the end walls 22, 26 and side wall 24 are also placed in tension upon inflation of the inflatable wedges 14, 16 and resist inflation of the wedges 14, 16 beyond the intended wedge shape. The baffles 34, 36, 38 also help to distribute the flow of air within the wedge 14, 16 so the air is not focused entirely at the center of the upper wall 20 to limit ballooning. The baffles 34, 36, 38 also distribute the flow of air so that the air is not focused at the edge seams of the wedge 14, 16 to limit tears and leaks at the edge seams.

In one embodiment, the inflatable wedges 14, 16 each position a surface portion of the upper wall 20 thereof at an angle of approximately 30 degrees relative to an adjacent portion of an upper surface 46 of the cover layer 30 upon inflation of the wedges 14, 16. The phrase approximately 30 degrees is intended to encompass exactly 30 degrees as well as some variation customary to patient positioning wedges, such as plus or minus five degrees.

Regarding FIG. 1, the inflatable sheet 12 includes one or more handles 50 that may be grasped and used to push or pull the inflatable patient repositioning sheet 10 in directions 52, 54. The inflatable sheet 12 further includes one or more air inlets 60 which may take a variety of forms such as the sheet air inlet 62 shown in FIG. 4 and discussed in greater detail below. The inflatable sheet 12 may also include a head-receiving portion 64 and an indicator line 66. The indicator line 66 indicates the position of an upper edge of an absorbent incontinence pad that may be placed on the cover layer 30.

Regarding FIG. 2, a portion of the inflatable patient repositioning sheet 10 is shown in an exploded view. The upper wall 20 includes end edges 70, 72 that are joined to upper edges 74 of the end walls 22, 26. A center edge 78 may be joined to a tip 80 of the end walls 22, 26 and to the cover layer 30. The end walls 22, 26 each include a lower edge 84 joined to the cover layer 30 and a side edge 86 joined to the side wall 24. The baffles 34, 36, 38 include upper edges 90 that are joined to the upper wall 20 at the joints 40, lower edges 92 that are joined to the cover layer 30, and side edges 94 that are spaced from the side wall 24.

Figure 3:
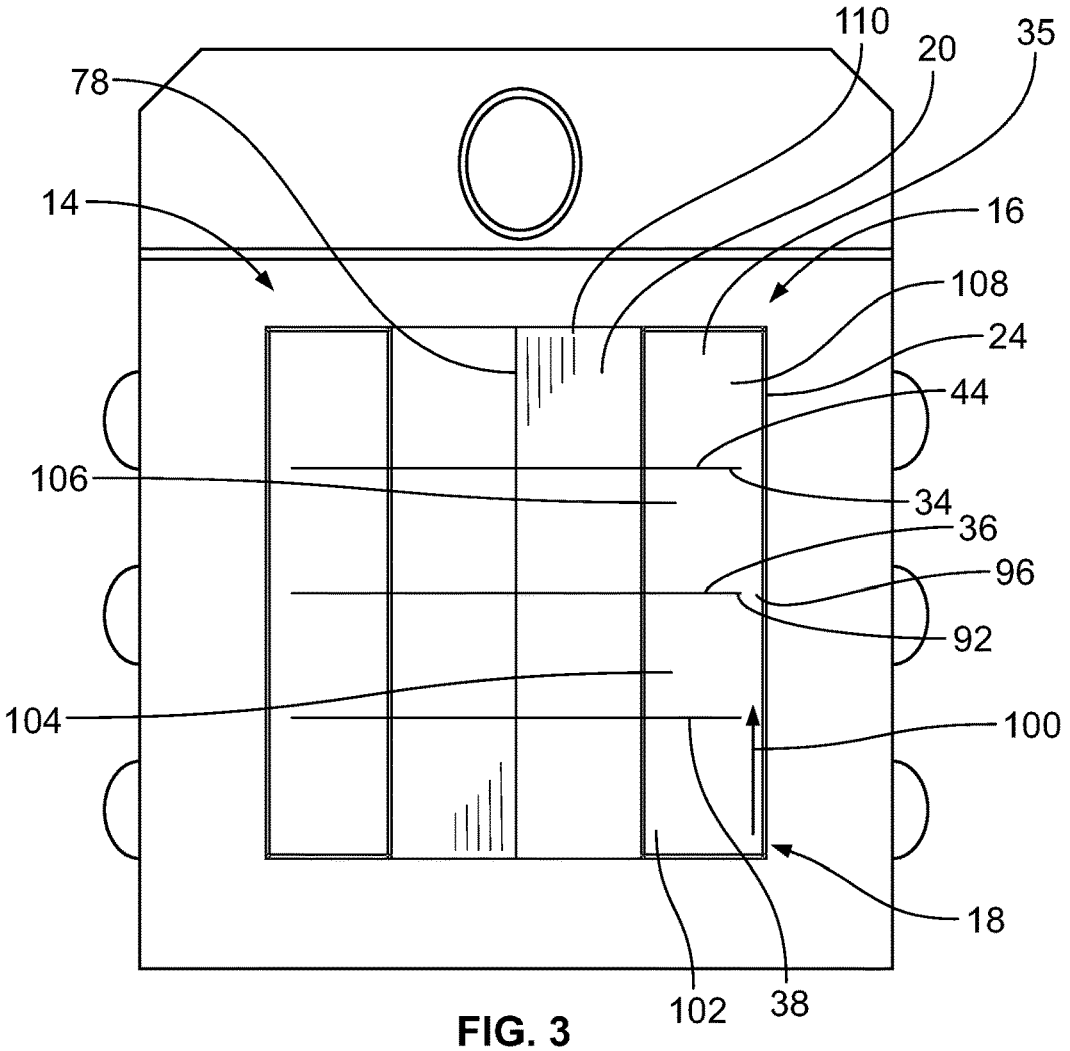
FIG. 3 is a cross-sectional view taken across line 3-3 in FIG. 1 halfway up along the inflatable wedges, showing internal baffles of the inflatable wedges separating chambers of the inflatable wedges.

Regarding FIG. 3, each inflatable wedge 14, 16 includes one or more chambers, such as chambers 102, 104, 106, 108 separated by the baffles 34, 36, 38. The side edges 92 of the baffles 34, 36, 38 are separated by a gap 96 from the side wall 24. The gaps 96 permit air that enters the inflatable wedge 14, 16 via the wedge air inlet 18 to travel in direction 100 from the chamber 102 to the chambers 104, 106, 108 and fill the inflatable wedge 16. In FIG. 3, the cross-section is taken approximately halfway up the wedges 14, 16 to show the upper wall 20 and an upper, patient-supporting surface 110 thereof extending away from the center edge 78 of the upper wall 20 toward the side wall 24. In one approach, the center edges 78 of the upper walls 20 of both inflatable wedges 14, 16 are joined to the cover layer 30 with a single joint that runs along the length of the upper walls 30.

Returning to FIG. 2, the upper layer 120 and the lower layer 122 may be urged apart by supplying air to the sheet air inlet 60 of the inflatable sheet 12. The cover layer 30 has a laminated configuration with the upper layer 120 and such that the cover layer 30 and inflatable wedges 14, 16 thereon move with the upper layer 120 away from the lower layer 122 as air is provided to the sheet air inlet 60. The cover layer 30, upper layer 120, and lower layer 122 have peripheral edges 126, 128, 130 that may be joined together, such as by heat welding, ultrasonic welding, and/or adhesive as some examples.

Figure 4:
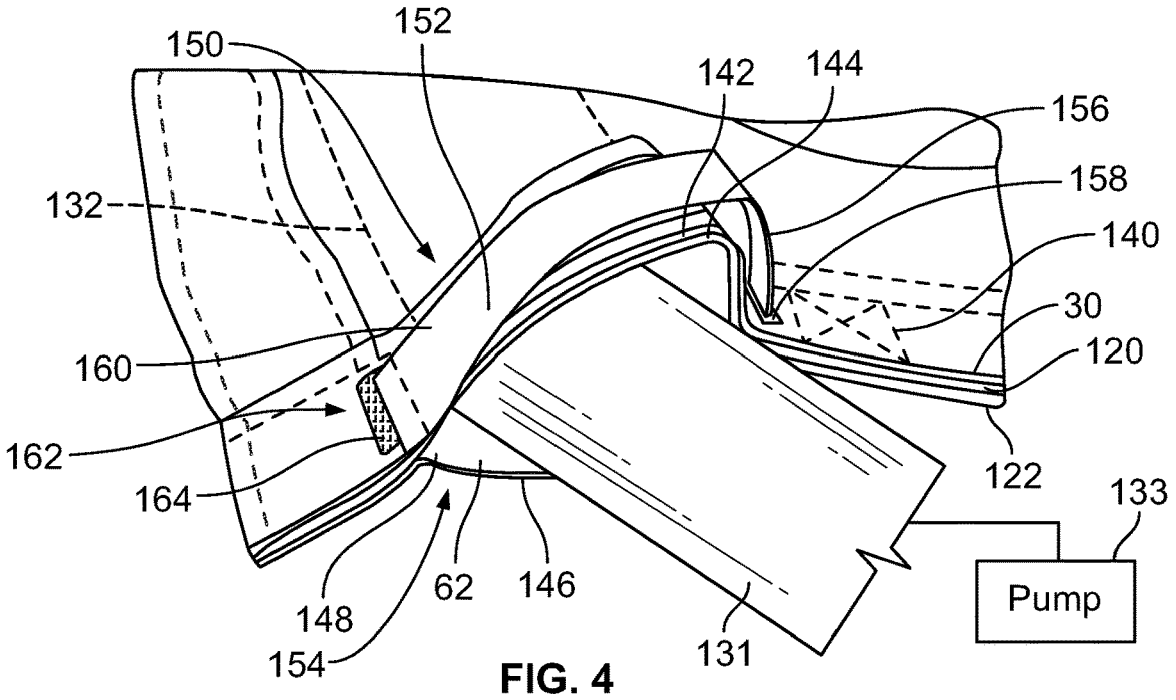
FIG. 4 is a perspective view of an example air inlet of the patient repositioning sheet of FIG. 1.

Regarding FIG. 4, the sheet air inlet 62 is configured to receive an outlet tube 131 of an air pump 133. The inflatable sheet 12 may include an internal tubular sock 132 that receives air from the tube 131 and distributes air across the width of the inflatable sheet 12. In FIG. 4, the cover layer 30, upper layer 120, and lower layer 122 are shown joined around the peripheral edges 126, 128, 130 via stitching 140. The cover layer 30 and upper layer 120 have portions 142, 144 joined together that may be separated from a portion 146 of the lower layer 122 to define an opening 148 between the portions 144, 146 that permits the tube 131 to be placed in communication with the tubular sock 135. In one embodiment, the sheet air inlet 62 includes an adjustable closure 150 that has a closure member, such as a strap 152, with an anchor portion 154 secured to the lower layer 122, an intermediate portion 156 that extends through an opening 158 in the cover layer 30 and upper layer 120, and an end portion 160 that is outside of the cover layer 30 and upper layer 120. The adjustable closure 150 may include a hook and loop closure 162 of the end portion 160 and the cover layer 30. The hook and loop closure 162 include loops 164 on the cover layer 30 that engage hooks on the underside of the end portion 160 of the strap 152. A user may constrict the adjustable closure 150 about the tube 131 by pulling the end portion 160 upward away from the opening 158 in the cover layer 30 and upper layer 120. The user then pivots the end portion 160 downward against the loops 164 to engage the hook and loop closure 162 and maintain the adjustable closure 150 in a constricted configuration about the tube 131. The constricted adjustable closure 150 restricts air escaping via the sheet air inlet 62 as air discharges from the tube 131 into the inflatable sheet 12.

In one embodiment, the wedge air inlets 18 of the inflatable wedges 14, 16 may be similar to the sheet air inlet 62 of FIG. 4. For example, the wedge air inlets 18 may include an opening for receiving an air supply tube (e.g., tube 131) and an adjustable closure 150 to constrict the opening about the air supply tube. In this manner, the same pump 133 and air supply tube 131 may be used to inflate any of the inflatable sheet 12, inflatable wedge 14, and inflatable wedge 16 as desired by a user. Further, in one embodiment, the internal volumes of the inflatable sheet 12 and inflatable wedges 14, 16 are not in communication with each other such that the pump 133 may be used to independently inflate any one of the inflatable sheet 12, inflatable wedge 14, and inflatable wedge 16.

The inflatable supports of the inflatable patient repositioning sheet 10 may have shapes other than the wedges 14, 16. For example, the inflatable supports may include rectangular, dome-shaped, and half-cylindrical inflatable supports as some examples.

Figure 5:
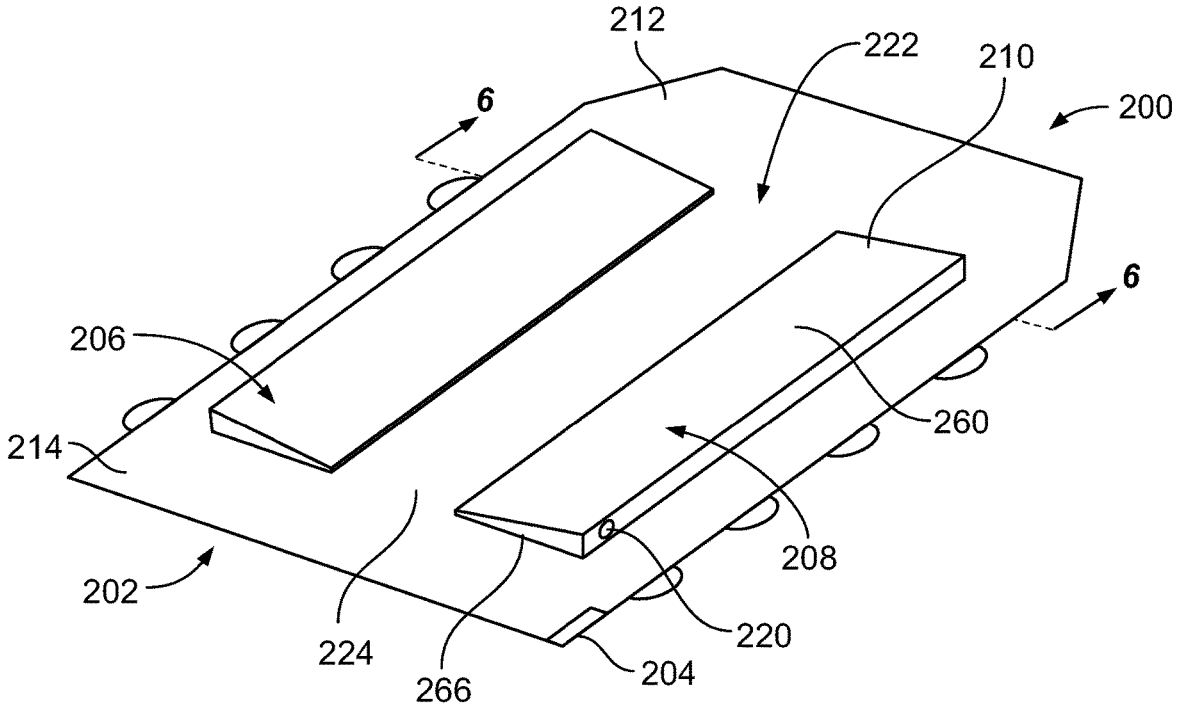
FIG. 5 is a perspective view of another patient repositioning sheet including an inflatable sheet and a pair of inflatable wedges of the inflatable sheet.

Regarding FIG. 5, an inflatable patient repositioning sheet 200 is provided that is similar in many respects to the inflatable patient repositioning sheet 10 discussed above such that differences will be highlighted. The inflatable patient repositioning sheet 200 includes an inflatable sheet 202 having one or more sheet air inlets 204 and one or more inflatable wedges, such as inflatable wedges 206, 208. In FIG. 5, one inflatable wedge 206, 208 is provided on each side of the inflatable sheet 202. The inflatable wedges 206, 208 are elongated and extend for a majority of the length of the inflatable patient repositioning sheet 200, such as more than 55 percent, more than 60 percent, more than 70 percent, more than 80 percent, or more than 90 percent of the length of the inflatable patient repositioning sheet 200. The lengths of the inflatable wedges 206, 208 permit the inflatable wedges 206, 208 to reposition patients of varying heights because the supported portion of the patient, such as a patient's hip, may be positioned anywhere along the inflatable wedges 206, 208. In other embodiments, there may be two or more inflatable wedges positioned on each side of the inflatable sheet 202.

With reference to FIG. 5, the inflatable wedges 206, 208 each include an upper wall 210 that may be inclined relative to an upper surface 212 of a cover layer 214, such as at an angle of approximately 30 degrees, when the inflatable wedge 206, 208 is inflated. The inflatable wedges 206, 208 each include one or more wedge air inlets 220 that may receive air from a pump. The inflatable patient repositioning sheet 200 includes a gap 222 between the inflatable wedges 206, 208. In one embodiment, the inflatable wedges 206, 208 are separated by a surface portion 224 of the cover layer 214.

Figure 6:
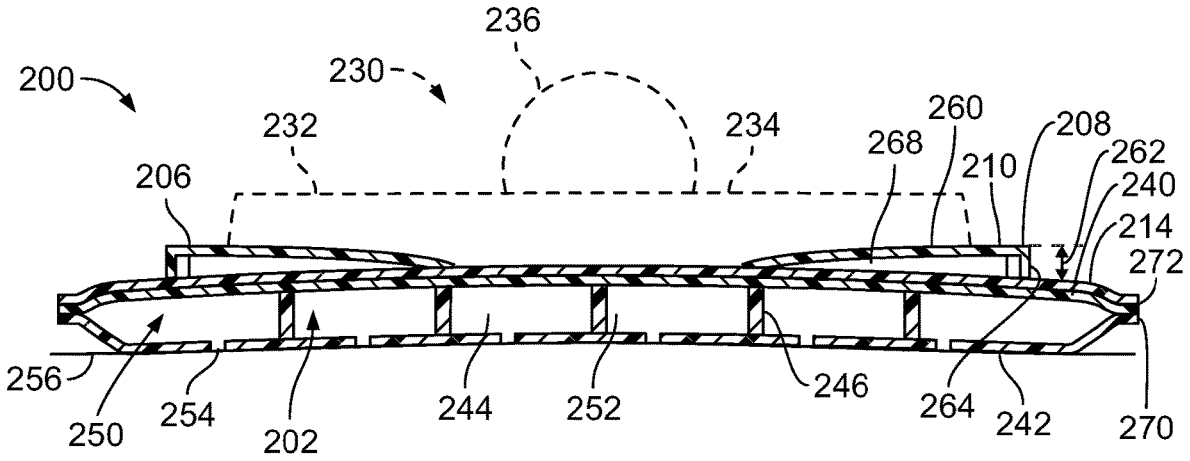
FIG. 6 is a cross-sectional view taken across line 6-6 in FIG. 5 showing the inflatable wedges and the inflatable sheet of the inflatable patient repositioning sheet of FIG. 5 in an initial, deflated configuration.

Regarding FIG. 6, the inflatable patient repositioning sheet 200 is shown in an initial, deflated configuration. The term deflated is used to refer to a state of inflation less than fully inflated. In FIG. 6, a patient 230 is shown in a supine position having a side 232 supported on the wedge 206, a side 234 supported on the inflatable wedge 208, and a head 236 supported on the upper surface 212 of the cover layer 214 (such as on a pillow). In one embodiment, the cover layer 214 is made of a high-friction material so that the upper surface 212 resists movement of the patient on the cover layer 214. For example, the cover layer 214 may be made of a microfiber material.

Regarding FIG. 6, the inflatable patient repositioning sheet 202 includes an upper layer 240 to which the cover layer 214 is secured and a lower layer 242 separated by an air gap 244 from the upper layer 240. The air gap 244 may be small or nonexistent when the inflatable patient repositioning sheet 202 is deflated. The inflatable sheet 202 may include one or more baffles 246 that divide an interior volume 250 of the inflatable sheet 202 into two or more chambers 252. The lower layer 242 may include a plurality of exit holes 254 that permit air pumped into the interior volume 250 to travel downward against a support surface 256 and create an air bearing therebetween the lower layer 242 and the surface 256.

In FIG. 6, each inflatable wedge 206, 208 has an upper wall 210 and a surface portion, such as an upper, patient supporting surface 260, at an angle 262. The inflatable wedges 206, 208 are shown in an initial deflated configuration, which may be partially or completely deflated, such that the angle 262 may be less than 20 degrees, such as less than 10 degrees, such as less than 5 degrees. The angle 262 may be generally limited by the material of the upper wall 210, a side wall 264, end walls 266 (see FIG. 5), and baffles 268 of the inflatable wedges 206, 208. Further, the cover layer 214, upper layer 240, and lower layer 242 may be joined at peripheral edges 270 thereof at a joint 272. The joint 272 may be formed using, for example, heat welding, ultrasonic welding, adhesive, and/or other approaches.

Figure 7:
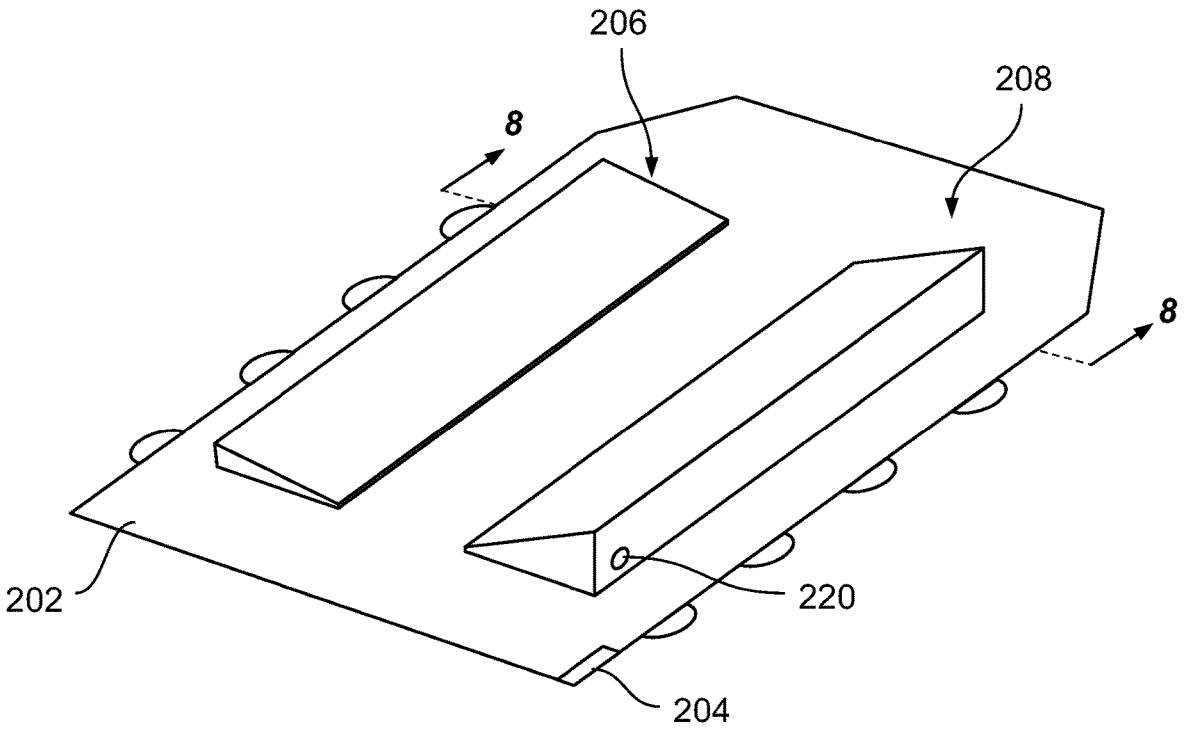
FIG. 7 is a perspective view similar to FIG. 5 showing one of the inflatable wedges in an inflated configuration and the inflatable sheet in the initial, deflated configuration.
Figure 8:
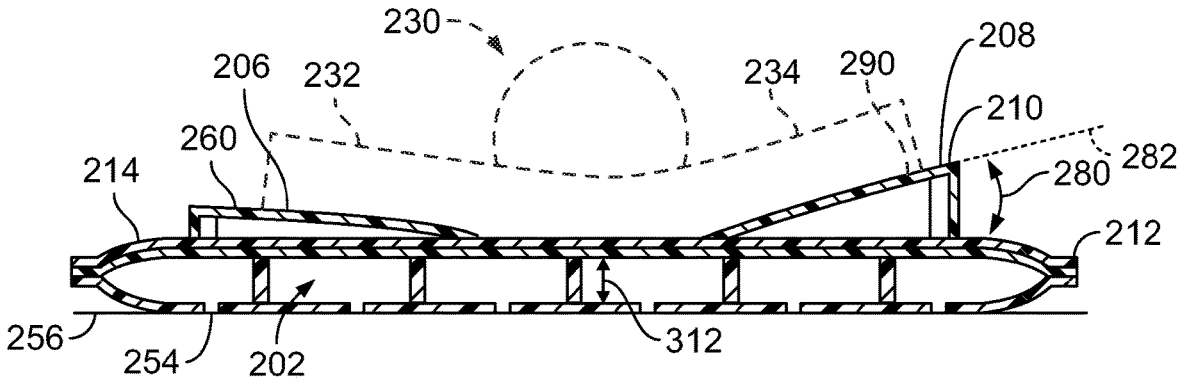
FIG. 8 is a cross-sectional view taken across line 8-8 in FIG. 7 showing a patient having a side elevated by the inflated wedge.

Regarding FIGS. 7 and 8, an air pump has been connected to the wedge air inlet 220 and operated to inflate the inflatable wedge 208 to an inflated configuration. The inflatable sheet 202 remains in the initial, deflated configuration during the wedge inflating process and provides a stable base for the patient 230. By inflating the inflatable wedge 208, the upper wall 210 thereof extends at an angle 280 relative to the upper surface 212 of the cover layer 214 that is larger than angle 262. In one embodiment, the angle 280 is greater than 20 degrees. For example, the angle 280 may be in the range of 20 degrees to approximately 40 degrees, such as approximately 30 degrees. The upper wall 210 may generally form a plane 282 that extends transversely to a plane of the upper surface 260 of the inflatable wedge 206.

Due to the inflation of the inflatable wedge 208, the side 234 of the patient 230 is elevated above the position that is shown in FIG. 6. By elevating the side 234, a portion 290 of the skin of the patient is relieved of pressure. For example, elevating the side 234 may relieve pressure on skin near sacral vertebrae of the patient. The inflation of the inflatable wedge 208 thereby performs patient repositioning without a user having to log roll the patient and position a foam wedge as in some prior approaches. The use of the inflatable wedge 208 to reposition the patient 230 reduces the manual labor involved in repositioning the patient 230.

Once the side 234 of the patient 230 has been elevated for a period of time, such as two hours, the inflatable wedge 208 may be deflated and the patient permitted to lie in the supine position flat on the deflated inflatable patient repositioning sheet 200 for a period of time, such as two hours. Next, the inflatable wedge 206 may be inflated to lift the other side 232 of the patient 230 and relieve pressure on the side 232 of the patient 230. The process of inflating and deflating the inflatable wedges 206, 208 may be performed in any order desired.

Figure 9:
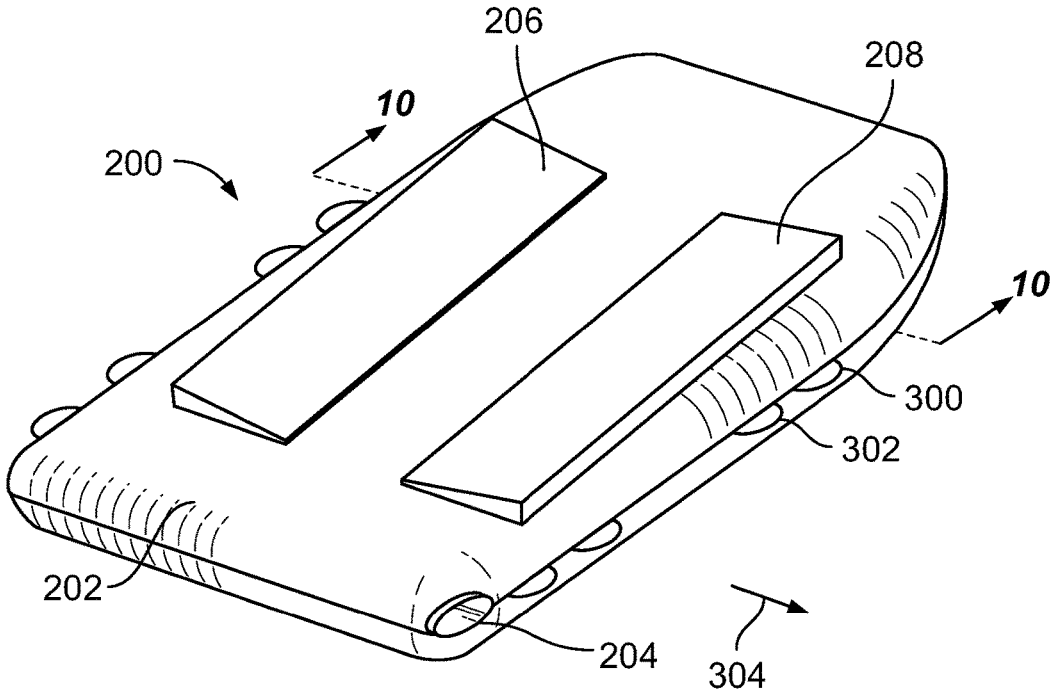
FIG. 9 is a perspective view similar to FIG. 5 showing the inflatable wedges in the initial, deflated configuration and the inflatable sheet in an inflated configuration.
Figure 10:
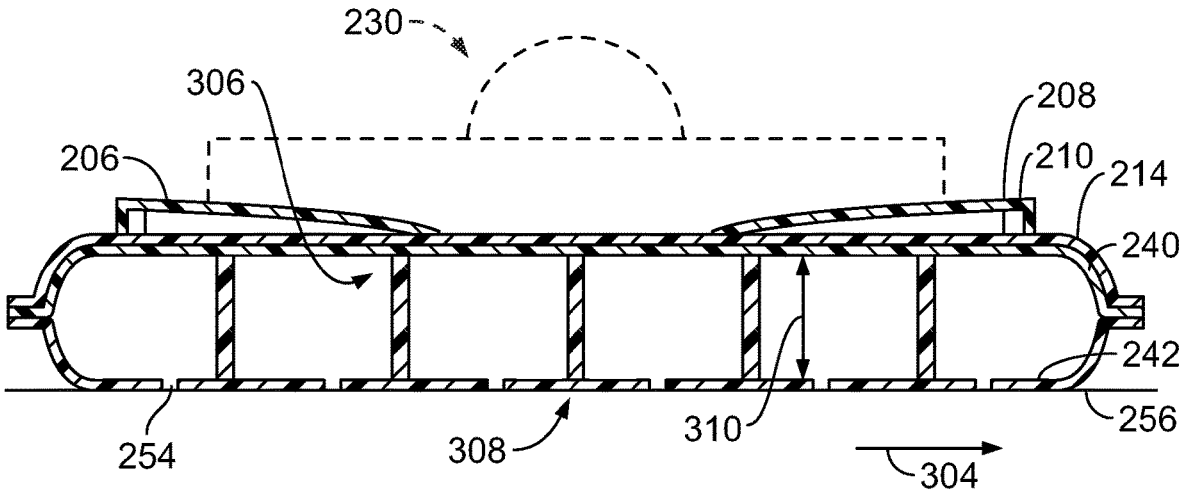
FIG. 10 is a cross-sectional view taken across line 10-10 in FIG. 9 showing longitudinal baffles in the inflated inflatable sheet.

Regarding FIGS. 9 and 10, the inflatable patient repositioning sheet 200 is shown with the inflatable wedges 206, 208 in the initial, deflated configuration and the inflatable sheet 202 in an inflated configuration. The inflatable sheet 202 may be shifted from an initial, deflated configuration of FIG. 5 to the inflated configuration of FIG. 9 via an air pump connected to the air inlet 204. With the inflatable sheet 202 inflated, the inflatable patient repositioning sheet 200 includes one or more handles, such as handles 300, 302 that may be grasped and used to push and/or pull the inflatable patient repositioning sheet 200 and patient 230 thereon, such as in a lateral direction 304.

Regarding FIG. 10, the air provided to the air inlet 204 inflates the inflatable sheet 202 and shifts a center portion 306 of the cover layer 214 and upper layer 240 away from a center portion 308 of the lower layer 242. This creates a distance 310 between the upper layer 240 and a lower layer 242 that is greater than a distance 312 (see FIG. 8) when the inflatable sheet 202 is in the initial, deflated configuration thereof. The larger surface area provided by the inflated inflatable sheet 202 as well as the air traveling through holes 254 in the lower layer 242 reduces the resistance to shifting of the inflatable sheet 202 along the surface 256. The reduced resistance makes it easier for a nurse to shift the inflatable patient repositioning sheet 200 and patient 230 thereon from the surface 256 to another surface.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service. It is intended that the phrase "at least one of" as used herein be interpreted in the disjunctive sense. For example, the phrase "at least one of A and B" is intended to encompass only A, only B, or both A and B.

What is claimed is:

1. A method of repositioning a patient, the method including: positioning a patient repositioning apparatus between a patient and a support surface, the patient repositioning apparatus including an inflatable sheet and an inflatable support of the inflatable sheet, the inflatable support mounted to a cover layer of the inflatable sheet such that the cover layer extends about the inflatable support, wherein a lower portion of the inflatable support is integrally connected with the cover layer, the cover layer made of a high-friction material for engaging the patient and inhibiting movement of the patient relative to the inflatable sheet; inflating the inflatable support to elevate a portion of the patient; deflating the inflatable support to lower the portion of the patient; inflating the inflatable sheet and causing air to travel through holes in a lower layer of the inflatable sheet toward the support surface; and transferring the patient transfer apparatus and the patient thereon from the support surface to another surface while the inflatable sheet is inflated and the inflatable support is uninflated.

2. The method of claim 1 wherein the inflatable sheet includes an upper layer opposite the lower layer;

wherein the inflatable support includes a first inflatable wedge mounted to the upper layer of the inflatable sheet;

wherein the inflatable support includes a second inflatable wedge mounted to the upper layer of the inflatable sheet; and wherein inflating the inflatable support includes inflating the first inflatable wedge while the inflatable sheet and the second inflatable wedge are uninflated, wherein the first inflatable wedge and the second inflatable wedge each include a portion of the cover layer of the inflatable sheet.

3. The method of claim 2 further comprising:

inflating the second inflatable wedge while the inflatable sheet and the first inflatable wedge are uninflated.

4. The method of claim 1 wherein inflating the inflatable support includes inflating the inflatable support while the inflatable sheet is uninflated.

5. The method of claim 4 wherein inflating the inflatable sheet includes inflating the inflatable sheet after deflating the inflatable support.

6. The method of claim 4 further comprising:

inflating another inflatable support of the patient repositioning apparatus to elevate another portion of the patient.

7. The method of claim 1 wherein inflating the inflatable support includes inflating the inflatable support while another inflatable support of the patient repositioning apparatus is uninflated.

8. The method of claim 1 wherein the inflatable support includes a wedge; and wherein inflating the inflatable support includes reconfiguring an upper wall of the wedge from a lowered position to an inclined, raised position wherein the upper wall extends obliquely to an upper surface of the inflatable sheet.

9. The method of claim 1 wherein inflating the inflatable support includes connecting a pump to an air inlet of the inflatable support.

10. The method of claim 9 wherein the inflatable support includes a wedge comprising an upper wall and at least one side wall connecting a periphery of the upper wall to the cover layer of the inflatable sheet; and wherein connecting the pump to the air inlet of the inflatable support includes connecting the pump to the air inlet of the at least one side wall of the wedge.

11. The method of claim 1 wherein the inflatable support includes a wedge having an upper wall, the method further comprising:

permitting air to escape through the upper wall of the wedge.

12. The method of claim 1 wherein the patient repositioning apparatus includes a one-way valve, the method further comprising connecting a pump to the one-way valve; and wherein inflating the inflatable support includes directing air into the inflatable support via the one-way valve.

13. The method of claim 1 wherein the cover layer includes a microfiber material.

14. The method of claim 1 wherein the cover layer is laminated to an upper layer of the inflatable sheet.

15. The method of claim 1 further comprising placing an absorbent incontinence pad on the cover layer.

16. The method of claim 1 wherein the inflatable support is above the cover layer.

17. The method of claim 1 wherein baffles of the inflatable support are connected to the cover layer.

18. The method of claim 1 wherein the cover layer of the inflatable sheet is exposed between first and second inflatable wedges of the inflatable support for supporting a patient thereon.

* * * * *